US009732692B2

(12) United States Patent
Onozawa

(10) Patent No.: US 9,732,692 B2
(45) Date of Patent: Aug. 15, 2017

(54) APPARATUS FOR DIAGNOSING FUEL PRESSURE SENSOR CHARACTERISTIC FAULT

(71) Applicant: Fuji Jukogyo Kabushiki Kaisha, Tokyo (JP)

(72) Inventor: Ryo Onozawa, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 14/577,696

(22) Filed: Dec. 19, 2014

(65) Prior Publication Data

US 2015/0184610 A1 Jul. 2, 2015

(30) Foreign Application Priority Data

Dec. 27, 2013 (JP) ..... 2013-271588

(51) Int. Cl.

| | |
|---|---|
| ***F02B 3/00*** | (2006.01) |
| ***F02D 41/22*** | (2006.01) |
| ***F02D 41/38*** | (2006.01) |
| *F02D 41/04* | (2006.01) |
| *F02D 41/18* | (2006.01) |

(52) U.S. Cl.

CPC ..... *F02D 41/222* (2013.01); *F02D 41/3836* (2013.01); *F02D 41/042* (2013.01); *F02D 41/18* (2013.01); *F02D 2041/223* (2013.01); *F02D 2200/022* (2013.01)

(58) Field of Classification Search

CPC ..... F02D 41/222; F02D 2041/223; F02D 2041/224

USPC ..... 123/294; 701/103, 104; 73/114.43

See application file for complete search history.

(56) References Cited

U.S. PATENT DOCUMENTS

| | | | | |
|---|---|---|---|---|
| 4,111,173 | A * | 9/1978 | Skinner | F02D 1/127 123/502 |
| 5,633,458 | A * | 5/1997 | Pauli | F02D 41/22 701/105 |
| 6,276,131 | B1 * | 8/2001 | Ueno | F02D 31/003 123/339.11 |
| 2004/0002810 | A1 * | 1/2004 | Akuzawa | F02D 41/22 701/114 |
| 2004/0267435 | A1 * | 12/2004 | Fujimoto | F02M 25/0809 701/107 |

(Continued)

FOREIGN PATENT DOCUMENTS

| | | |
|---|---|---|
| EP | 1 371 838 A1 | 12/2003 |
| JP | H10-054317 A | 2/1998 |

(Continued)

OTHER PUBLICATIONS

Japanese Office Action dated Nov. 4, 2015 with an English translation thereof.

*Primary Examiner* — Marguerite McMahon
*Assistant Examiner* — James Kim
(74) *Attorney, Agent, or Firm* — McGinn IP Law Group, PLLC

(57) ABSTRACT

After an ECU is activated by turning a key switch on, if a total intake air quantity, which is indicative of the engine temperature immediately before turn-off of the key switch, exceeds a set intake air quantity indicative of a full warm-up determination temperature, and a soak time exceeds a set key-off time, it is determined that the condition for executing a diagnosis of a fuel pressure sensor is satisfied.

14 Claims, 4 Drawing Sheets

(56) References Cited

U.S. PATENT DOCUMENTS

| | | | | |
|---|---|---|---|---|
| 2006/0231080 | A1 | 10/2006 | Tomatsuri et al. | |
| 2008/0209990 | A1 | 9/2008 | Hanari et al. | |
| 2010/0280741 | A1* | 11/2010 | Wang | F02D 41/222 701/103 |
| 2010/0294030 | A1* | 11/2010 | Lucido | F02D 41/221 73/114.43 |
| 2011/0160981 | A1* | 6/2011 | Rieger | F02D 41/1454 701/103 |
| 2011/0307161 | A1* | 12/2011 | Sommerer | F02D 41/222 701/103 |
| 2012/0215422 | A1* | 8/2012 | Sugiyama | F02D 41/3845 701/104 |
| 2012/0245824 | A1* | 9/2012 | Miura | F02D 41/22 701/104 |
| 2013/0019668 | A1* | 1/2013 | Guerrassi | F02D 35/023 73/114.16 |
| 2013/0125862 | A1 | 5/2013 | Sahashi | |

FOREIGN PATENT DOCUMENTS

| | | | |
|---|---|---|---|
| JP | 2001-173507 | A | 6/2001 |
| JP | 2002-276441 | A | 9/2002 |
| JP | 2006-299824 | A | 11/2006 |
| JP | 2006-329033 | A | 12/2006 |
| JP | 3966130 | B2 | 8/2007 |
| JP | 2008-215138 | A | 9/2008 |
| JP | 2009-180158 | A | 8/2009 |
| JP | 2010-270684 | A | 12/2010 |
| JP | 2011-202541 | A | 10/2011 |
| JP | 2013-108463 | A | 6/2013 |

* cited by examiner

APPARATUS FOR DIAGNOSING FUEL PRESSURE SENSOR CHARACTERISTIC FAULT

CROSS-REFERENCE TO RELATED APPLICATIONS

The present application claims priority from Japanese Patent Application No. 2013-271588 filed on Dec. 27, 2013, the entire contents of which are hereby incorporated by reference.

BACKGROUND

1. Technical Field

The present invention relates to an apparatus for diagnosing a fuel pressure sensor characteristic fault which diagnoses the presence of a fault in a fuel pressure sensor that is provided in a fuel system to detect the pressure of fuel.

2. Related Art

In direct injection engines, an injector (fuel injector) is provided for each cylinder to directly inject fuel into the cylinder, fuel stored in a fuel tank is pressurized by a low-pressure pump and then further pressurized by a high-pressure fuel pump (high-pressure fuel generator) before being introduced into a high-pressure fuel gallery, and the fuel is directly injected into the cylinder from the injector that communicates with this high-pressure fuel gallery.

The fuel pressure supplied to the high-pressure fuel gallery is controlled by a controller (ECU). In the controller, first, a target fuel pressure is set in accordance with the running condition of the engine, and feedback control is performed so that the actual fuel pressure detected by a fuel pressure sensor converges to the target fuel pressure. Then, fuel is injected from the injector into the cylinder for the duration of a fuel injection time corresponding to a target fuel injection quantity, which is set in accordance with the fuel pressure detected by the fuel pressure sensor and the running condition of the engine.

To provide optimal control of the fuel pressure supplied to the high-pressure fuel gallery, and fuel injection quantity, it is necessary for the output characteristics of the fuel pressure sensor to fall within a predetermined tolerance range. Further, a break or ground fault in the lead wire of the fuel pressure sensor makes the fuel pressure sensor unable to give an accurate fuel pressure reading.

For example, Japanese Patent No. 3966130 discloses the following technique. According to the technique, when a preset soak time (the time from engine stop to turn-on of a key switch) elapses, it is determined that the fuel pressure supplied to the high-pressure fuel gallery (common rail) has dropped to a pressure equivalent to the atmospheric pressure, thus enabling fault determination (characteristic diagnosis) for the fuel pressure sensor (common rail pressure sensor). Then, it is determined whether the fuel pressure stored in the high-pressure fuel gallery falls outside a predetermined range, and if this fuel pressure is outside the predetermined range, it is determined that a fault in the characteristics of the fuel pressure sensor (to be also referred to as "characteristic fault" hereinafter) is present on the low output side.

According to the technique disclosed in Japanese Patent No. 3966130 mentioned above, when determining a characteristic fault in the fuel pressure sensor, if the soak time is longer than a preset time, it is estimated that the fuel pressure supplied to the high-pressure fuel gallery (common rail) has dropped to a pressure equivalent to the atmospheric pressure.

However, the time required for the fuel pressure supplied to the high-pressure fuel gallery to drop to a pressure equivalent to the atmospheric pressure varies greatly with the operating condition immediately before engine stop. Therefore, if the preset time is short, this does allow the fuel pressure in the high-pressure fuel gallery to sufficiently drop to a pressure equivalent to the atmospheric pressure, making it impossible to perform a characteristic fault diagnosis of the fuel pressure sensor. Accordingly, it is necessary to set the preset time mentioned above to such a length of time that allows the fuel pressure supplied to the high-pressure fuel gallery to sufficiently drop to a pressure equivalent to the atmospheric pressure. This means that the characteristic fault diagnosis may not be performed unless the soak time is relatively long, reducing the opportunities for diagnosis.

It is preferable to start a diagnosis of a characteristic fault in the fuel pressure sensor is preferably as early as possible after engine stop. This reduces the influence of disturbance, allowing high accuracy diagnosis.

The technique disclosed in Japanese Patent No. 3966130 above also proposes a technique in which, instead of using a set time that is compared with the soak time, the fuel pressure in the high-pressure fuel gallery is estimated to have dropped to a pressure equivalent to the atmospheric pressure if one of the coolant temperature, the intake temperature, the fuel temperature, and the engine oil temperature after engine stop has dropped by a predetermined value or more. However, detecting the coolant temperature or the like at turn-on of the key switch, and estimating if the fuel pressure has dropped to a pressure equivalent to the atmospheric pressure on the basis of the detected temperature means that a complex condition needs to be satisfied in order to execute the diagnosis (to be also referred to as "diagnosis execution condition" hereinafter).

Furthermore, with the technique disclosed in Japanese Patent No. 3966130 above, it is not possible to discriminate whether the faulty condition of the fuel pressure sensor is due to a characteristic fault or a ground fault.

SUMMARY OF THE INVENTION

Accordingly, it is an object of the present invention to provide an apparatus for diagnosing a fuel pressure sensor characteristic fault which does not require a complex condition to be satisfied in order to execute a characteristic fault diagnosis of a fuel pressure sensor, allows a high accuracy diagnosis to be performed with a relatively short soak time, and also increases the opportunities for performing a characteristic fault diagnosis of the fuel pressure sensor that detects the fuel pressure supplied to a fuel rail, thereby increasing the reliability of the fuel pressure sensor.

An aspect of the present invention provides an apparatus for diagnosing a fuel pressure sensor characteristic fault, including a fuel injector that is opposed to each of cylinders and injects fuel directly to each of the cylinders, a high-pressure fuel generator that is driven by an engine and generates high-pressure fuel, a fuel pressure release unit that regulates an upper limit pressure of the high-pressure fuel, a fuel rail that supplies the fuel injector with the high-pressure fuel discharged from the high-pressure fuel generator, a fuel pressure sensor that is opposed to the pressure rail and detects a fuel pressure in the fuel rail, and a characteristic fault diagnosis unit that determines, after a key switch is turned off, whether a predetermined diagnosis execution condition is satisfied, and performs a diagnosis of a characteristic fault in the fuel pressure sensor if the diagnosis execution condition is satisfied. The characteristic fault diagnosis unit determines that the diagnosis execution condition is satisfied at least if an engine temperature immediately before turn-off of the key switch reaches a full warm-up temperature, and if a set key-off time elapses after the key switch is turned off.

DETAILED DESCRIPTION

Figure 1:
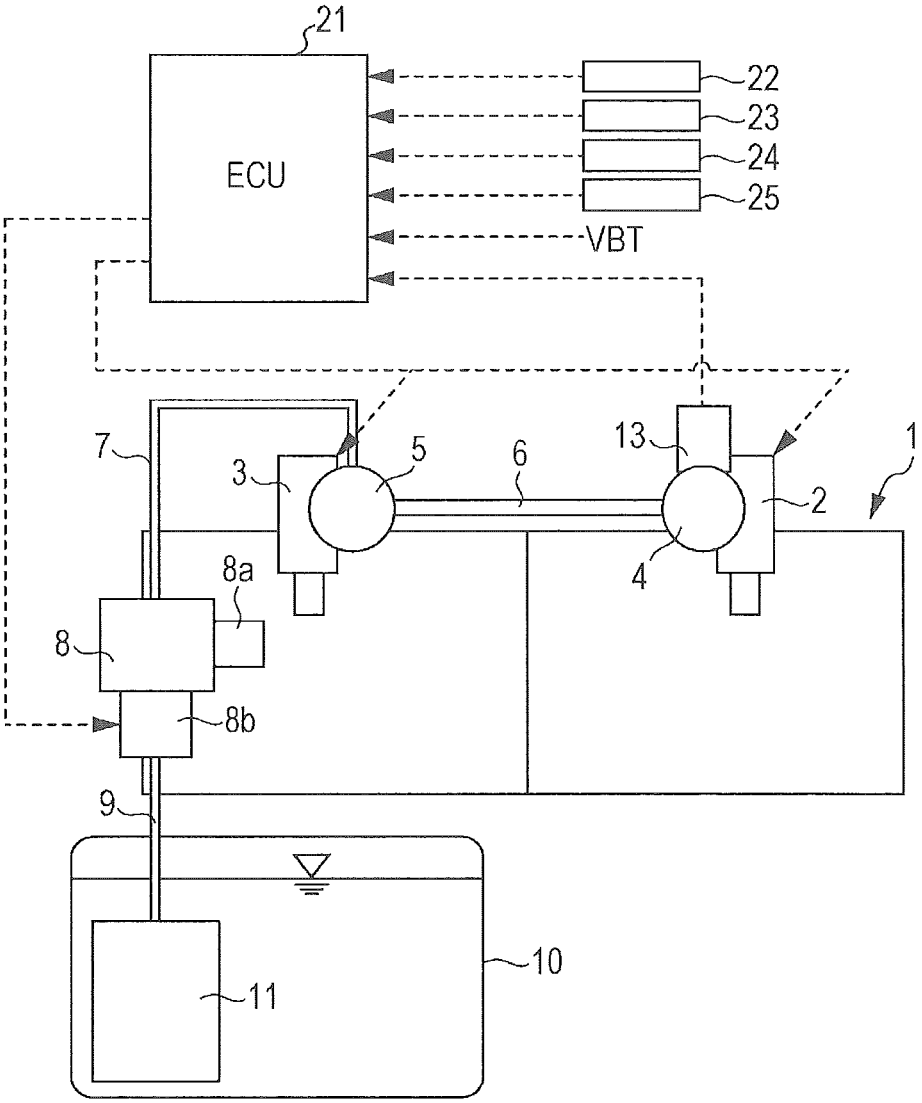
FIG. 1 is a schematic diagram illustrating a fuel injection control system of an in-cylinder direct injection engine.

Hereinafter, an implementation of the present invention will be described with reference to the figures. In FIG. 1, reference numeral 1 denotes an in-cylinder direct injection engine. A horizontally opposed four-cycle gasoline engine is illustrated in FIG. 1.

An injection nozzle at the tip of each of high-pressure injectors 2 and 3 serving as a fuel injector is opposed to a cylinder (not illustrated) provided in each of the left and right banks of the in-cylinder direct injection engine 1. High-pressure fuel galleries 4 and 5 that supply high-pressure fuel communicate with the high-pressure injectors 2 and 3, respectively.

The high-pressure fuel galleries 4 and 5 communicate with each other via a fuel gallery line 6. Accordingly, the fuel pressures supplied to the respective high-pressure fuel galleries 4 and 5 always have the same value. In this implementation, the downstream side of a high-pressure fuel line 7 communicates with the high-pressure fuel gallery 5 located in the left bank. An engine-driven high-pressure fuel pump 8 as a high-pressure fuel generator communicates with the upstream side of the high-pressure fuel line V. The high-pressure fuel pump 8 is implemented by a plunger pump or the like that boosts the fuel pressure to a predetermined pressure. A relief valve 8*a* is provided side-by-side with the high-pressure fuel pump 8. The relief valve 8*a* serves as a fuel pressure release unit that regulates the upper limit of the fuel pressure discharged from the high-pressure fuel pump 8. The fuel discharged from the relief valve 8*a* is returned to the low-pressure side inside the pump.

The downstream side of a low-pressure fuel line 9 communicates with the high-pressure fuel pump 8. The upstream side of the low-pressure fuel line 9 communicates with an electric low-pressure fuel pump 11 disposed inside a fuel tank 10. A fuel pressure control solenoid valve 8*b* is provided upstream of the high-pressure fuel pump 8. The fuel pressure control solenoid valve 8*b* controls the fuel pressure supplied to the high-pressure fuel gallery 5. Further, a fuel pressure sensor 13 is opposed to the high-pressure fuel gallery 4 located in the left bank.

The fuel pressure control solenoid valve 8*b* mentioned above is controlled by an electronic control unit (ECU) 21 that serves as a controller. The ECU 21 is implemented mainly by a microcomputer including a CPU, a ROM, a RAM, a backup RAM, and the like as required. Further, although not illustrated, various peripheral circuits are built in the ECU 21, such as a constant-voltage circuit that supplies stabilized power to various units, a drive circuit that drives the fuel pressure control solenoid valve 8*b* and the like, and an A/D converter that converts an analog signal outputted from the fuel pressure sensor 13 or the like into a digital signal.

Other than the fuel pressure sensor 13 mentioned above, the input side of the ECU 21 is connected to components such as an accelerator position sensor 22 that detects the amount of depression on an accelerator pedal, an engine speed sensor 23 that detects an engine speed Ne, a key switch 24, and an intake air quantity sensor 25 that detects an intake air quantity Q. Further, the input side of the ECU 21 receives a battery voltage VBT. Other than the fuel pressure control solenoid valve 8*b*, the output side of the ECU 21 is connected to components such as the high-pressure injectors 2 and 3.

The ECU 21 sets a target fuel pressure on the basis of the operating condition of the in-cylinder direct injection engine 1. Then, the ECU 21 controls the fuel pressure control solenoid valve 8*b* by feedback so that the fuel pressure supplied to the high-pressure fuel galleries 4 and 5 as detected by the fuel pressure sensor 13 converges to this target fuel pressure, thereby regulating the supply pressure of fuel. Further, on the basis of the engine speed Ne detected by the engine speed sensor 23, and the accelerator pedal position angle detected by the accelerator position sensor 22, the ECU 21 determines a basic fuel injection quantity by referencing a basic fuel injection map obtained through an experiment or the like in advance. Then, the ECU 21 applies, to each of the high-pressure injectors 2 and 3, a drive signal corresponding to the above-mentioned target fuel pressure and a fuel injection quantity computed from the basic injection quantity, and injects a measured amount of fuel to each of the corresponding cylinders.

As described above, the amount of fuel injected from the high-pressure injectors 2 and 3 depends on the pressure of fuel supplied to the high-pressure fuel galleries 4 and 5. Consequently, in the event of a fault in the characteristics of the fuel pressure sensor 13, it is not possible to inject an accurate measured amount of fuel from the high-pressure injectors 2 and 3. Accordingly, the ECU 21 checks a predetermined characteristic fault diagnosis execution condition (to be simply referred to as "diagnosis execution condition" hereinafter), either automatically when a predetermined soak time (the time from engine stop to turn-on of the key switch 24) elapses, or at turn-on of the key switch 24 after elapse of the predetermined soak time. If the diagnosis execution condition is satisfied, the characteristics of the fuel pressure sensor 13 are diagnosed, and if a fault is detected, the location of the fault is identified. In this implementation, a diagnosis is started when the driver turns the key switch 24 on.

Figure 2:
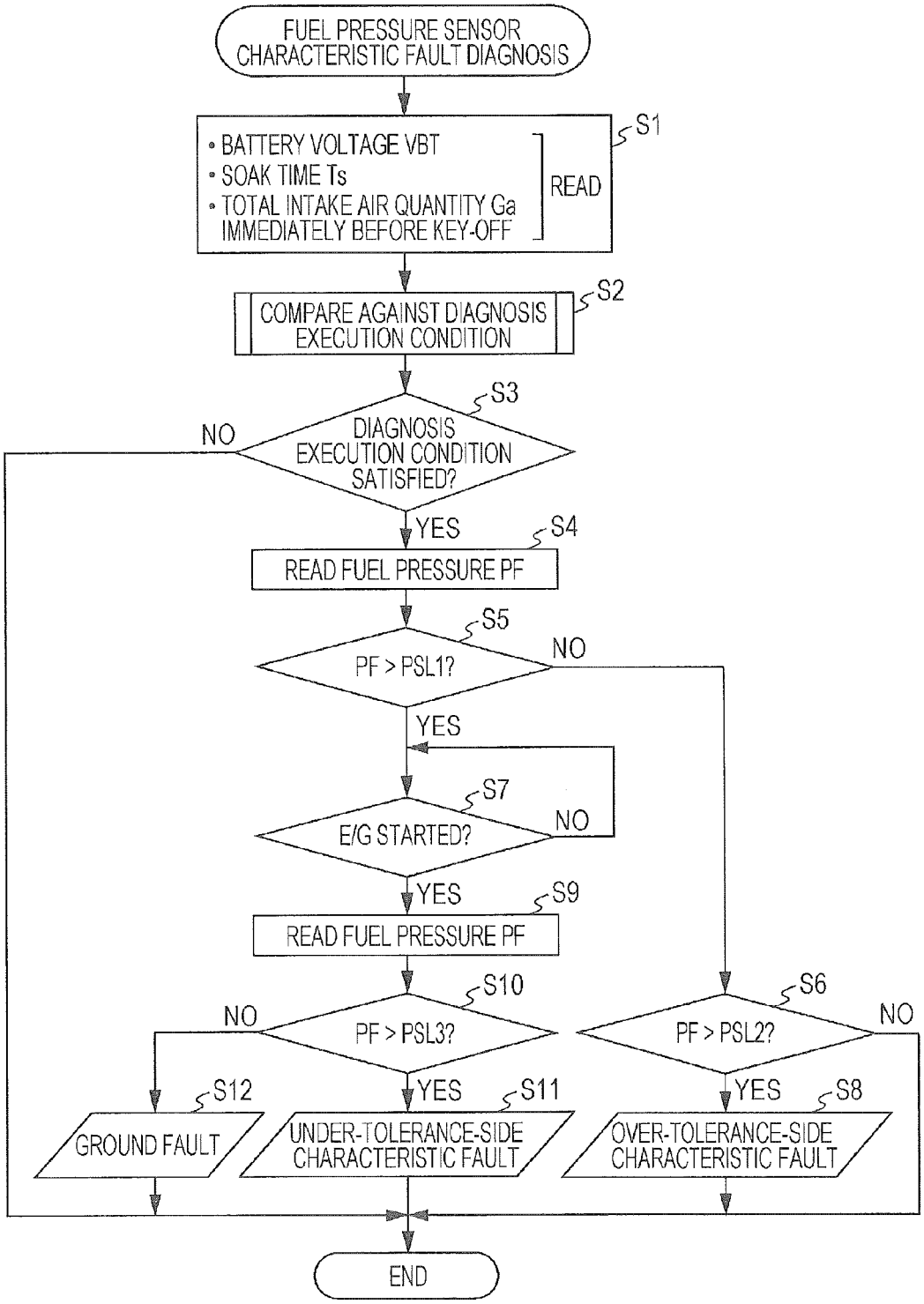
FIG. 2 is a flowchart illustrating a fuel pressure sensor characteristic fault diagnosis routine.

The characteristic fault diagnosis of the fuel pressure sensor 13 executed by the ECU 21 mentioned above is processed in accordance with a fuel pressure sensor characteristic fault diagnosis routine illustrated in FIG. 2.

This routine is executed only once after the driver turns the key switch 24 on (elapsed time t2 in FIG. 4A) and the ECU 21 is activated. First, in step S1, parameters required for a characteristic fault diagnosis are read. That is, the battery voltage VBT at turn-on of the key switch 24, a total intake air quantity Ga (the integral of the intake air quantity Q detected by the intake air quantity sensor 25 from when the engine starts to when the engine stops), which is the total amount of intake air up to a time point immediately before the in-cylinder direct injection engine 1 is stopped (elapsed time 0 in FIGS. 4A to 4E) by turning the key switch 24 off last time, and a soak time Ts (from elapsed time 0 to elapsed time t2 in FIG. 4E) are read.

Figures 4A, 4B, 4C, 4D, 4E:
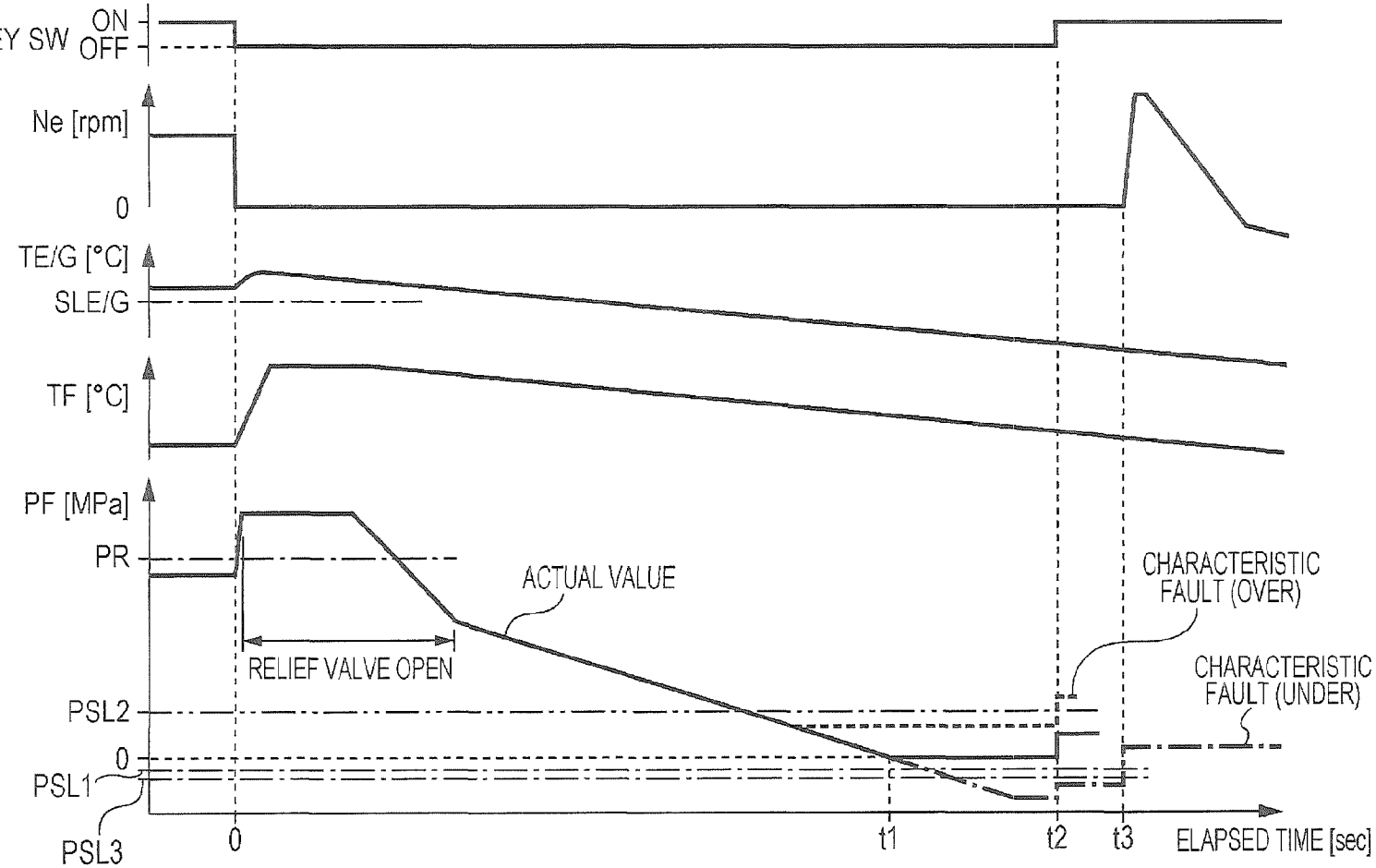
FIG. 4A is a time chart illustrating ON/OFF operation of a key switch.
FIG. 4B is a time chart illustrating changes in engine speed.
FIG. 4C is a time chart illustrating changes in engine temperature.
FIG. 4D is a time chart illustrating changes in the temperature of fuel in a fuel rail.
FIG. 4E is a time chart illustrating changes in the pressure of fuel in the fuel rail.

Then, the routine proceeds to step S2, and the following conditions are checked: whether the battery voltage VBT exceeds a set voltage; whether the soak time Ts is longer than a set key-off time (the time that is required for a fuel pressure PF to drop to a relative pressure (0 [Mpa]) equivalent to the atmospheric pressure, and equals the period of time from elapsed time 0 to elapsed time t1 in FIG. 4E); and whether the total intake air quantity Ga is greater than or equal to a predetermined intake air quantity. At this time, the set voltage is the lower limit value (for example, 10.5 [V]) at which the output value of the fuel pressure sensor 13 can be detected in a stable manner. The set voltage is calculated and set in advance through an experiment or the like.

The total intake air quantity Ga is a physical quantity that reflects the amount of heat generated by combustion in the in-cylinder direct injection engine 1. An engine temperature TE/G at engine stop can be estimated from the total intake air quantity Ga. In this implementation, however, it is not required to estimate an accurate engine temperature TE/G on the basis of the total intake air quantity Ga, since it is only necessary to determine whether the engine temperate TE/G at engine stop exceeds a full warm-up determination temperature and reaches a full warm-up temperature. The set intake air quantity that serves as the determination criterion is obtained in advance through an experiment or the like on the basis of a full warm-up determination temperature SLE/G.

As described above, whether a full warm-up state is reached is determined on the basis of the total intake air quantity Ga. Accordingly, as compared with the case of determining a full warm-up state on the basis of the operating time after engine start, the idle stop time is eliminated, thus allowing accurate determination of a full warm-up state. Alternatively, instead of the total intake air quantity Ga, a full warm-up state may be determined on the basis of the engine coolant temperature, or the total amount of fuel injected from engine start to engine stop.

When the in-cylinder direct injection engine 1 is stopped, the fuel changes its state while being confined in an enclosed space, and thus the fuel pressure of the high-pressure fuel system changes with fuel temperature. If the engine is stopped in a full warm-up state, the fuel in a fuel rail (a generic term collectively referring to the high-pressure fuel galleries 4 and 5, the fuel gallery line 6, and the high-pressure fuel line 7), which reaches the high-pressure injectors 2 and 3 from the high-pressure fuel pump 8, rises in pressure as the fuel is heated with the heat radiated from the in-cylinder direct injection engine 1. When this pressure exceeds a relief pressure PR of the relief valve 8*a* provided to the high-pressure fuel pump 8, the relief valve 8*a* opens, causing the fuel pressure in the fuel rail to leak to the low-pressure side. As a result, the density of the fuel in the fuel rail decreases. Consequently, the relationship between a fuel temperature TF and a fuel pressure PF changes, and a decrease in the fuel pressure PF is promoted (see FIGS. 4A to 4E). In FIG. 4E, after the relief valve 8*a* opens, the relief valve 8*a* does not close even when the fuel pressure PF becomes lower than the relief pressure PR. This is because hysteresis occurs owing to friction or the like.

According to this implementation, the warm-up state of the in-cylinder direct injection engine 1 which allows the relief valve 8*a* to be opened is formulated as a condition, and attention is directed to the fact that once this warm-up complete condition is satisfied, a decrease in fuel pressure is promoted, resulting in relative shortening of the set key-off time. Accordingly, after elapse of a predetermined soak time, a characteristic fault diagnosis of the fuel pressure sensor 13 is executed when the driver turns the key switch 24 on to activate the ECU 21.

For that purpose, in this implementation, the time required for the fuel pressure PF to drop to a relative pressure (0 [Mpa]) equivalent to the atmospheric pressure is determined in advance through an experiment or the like, and this value is used as the set key-off time. In this regard, it has been found from the experiment that with the soak time Ts of roughly 1 to 2 hours, the actual fuel pressure PF, which is the actual value illustrated in FIG. 4E, can be sufficiently lowered to a relative pressure (0 [Mpa]) equivalent to the atmospheric pressure. Therefore, in this implementation, this set key-off time is set to about 1.5 to 2 hours.

Then, the routine proceeds to step S3. In step S3, the comparison results in step S2 are checked, and it is determined that the diagnosis execution condition is satisfied if all of the following conditions are met: VBT>set voltage; Ts>set key-off time; and Ga (engine temperature TE/G) >predetermined intake air quantity (full warm-up determination temperature). Then, the routine proceeds to step S4. If even one of the above conditions is not met, the routine is ended as it is.

In this way, according to this implementation, whether the fuel pressure PF at engine stop exceeds the relief pressure PR of the relief valve 8*a* is added as a diagnosis execution condition. Therefore, after engine stop, a state in which the fuel pressure PF has been lowered to a pressure equivalent to the atmospheric pressure can be estimated in a relatively short time. As a result, the opportunities for performing a characteristic fault diagnosis of the fuel pressure sensor 13 at engine re-start can be increased. Furthermore, the ability to perform a characteristic fault diagnosis even with a relatively short soak time Ts reduces the influence of disturbance, resulting in high accuracy diagnosis.

Figure 3:
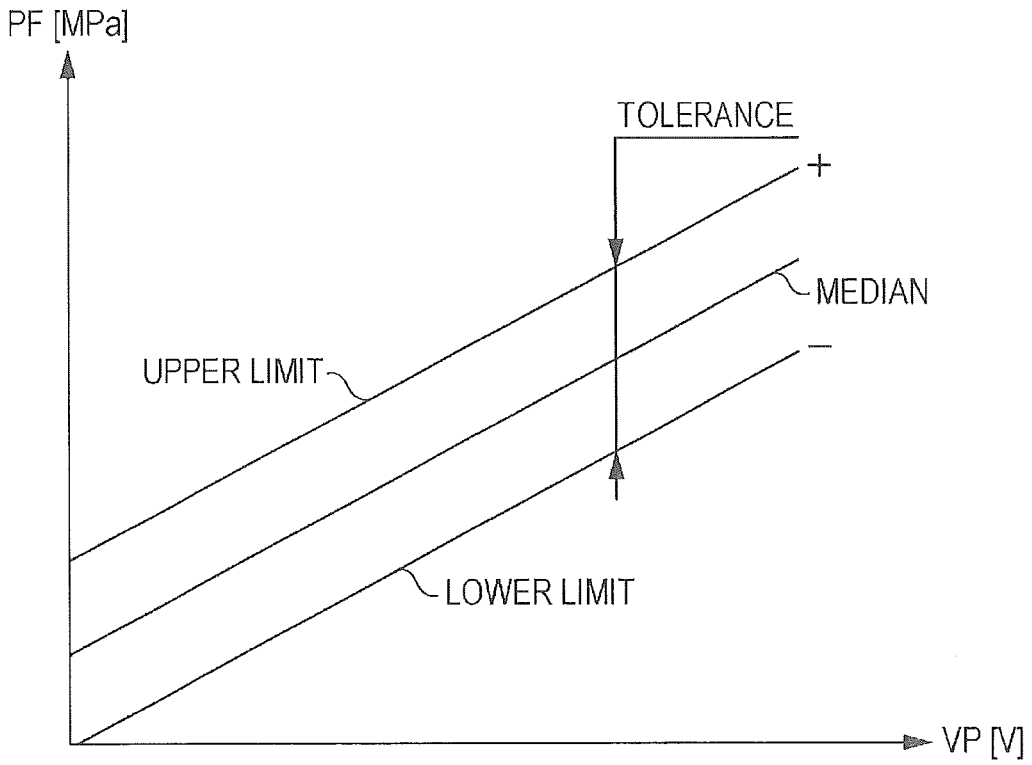
FIG. 3 is a characteristic diagram illustrating the relationship between the output value of a fuel pressure sensor and fuel pressure supplied to high-pressure fuel galleries.

If it is determined in step S3 mentioned above that the diagnosis execution condition is satisfied, and when the routine proceeds to step S4, the fuel pressure PF detected by the fuel pressure sensor 13 is read, and in steps S5 and S6, it is checked whether the read fuel pressure PF falls within a range of tolerances, including a tolerance for aging. As illustrated in FIG. 3, the fuel pressure sensor 13 has a tolerance range bounded by an upper limit (+) and a lower limit (−) with the median in between. A sensor output value VP [V] falling within this tolerance range is determined as normal, and a sensor output value VP [V] falling outside this tolerance range is determined as faulty.

When the driver turns the key switch 24 on, the electric low-pressure fuel pump 11 is driven, causing the fuel pressure generated in the electric low-pressure fuel pump 11 to be supplied to the high-pressure fuel galleries 4 and 5 via the high-pressure fuel pump 8 that is being stopped. As a result, as indicated by the actual value at elapsed time t2 in FIG. 4E, the instant the key switch 24 is turned on, the fuel pressure PF in the high-pressure fuel galleries 4 and 5 rises in accordance with the discharge pressure from the electric low-pressure fuel pump 11. Consequently, the fuel pressure PF detected by the fuel pressure sensor 13 at turn-on of the key switch 24 includes a pressure corresponding to the discharge pressure from the electric low-pressure fuel pump 11.

Therefore, by taking the influence of the discharge pressure from the electric low-pressure fuel pump 11 into account in advance, a tolerance lower limit threshold PSL1 and a tolerance upper limit threshold PSL2, which are used for fault determination when the key switch 24 is turned on, are each set to a value shifted to the high-pressure side.

Then, first, in step S5, the fuel pressure PF detected by the fuel pressure sensor 13, and the tolerance lower limit threshold PSL1 are compared with each other. If the fuel pressure PF is below (lower than) the tolerance lower limit threshold PSL1 (PF<PSL1), the routine proceeds to step S7, and if the fuel pressure PF is higher than or equal to the tolerance lower limit threshold PSL1 (PF≥PSL1), the routine jumps to step S6.

In step S6, the fuel pressure PF and the tolerance upper limit threshold PSL2 are compared with each other. If the fuel pressure PF is lower than or equal to the tolerance upper limit threshold PSL2 (PF≤PSL2), it is determined that the output value of the fuel pressure sensor 13 is within the tolerance range and hence normal, and the routine is ended as it is.

If it is determined that the fuel pressure PF exceeds the tolerance upper limit threshold PSL2 (PF>PSL2), it is determined that the output characteristic of the fuel pressure sensor 13 has an offset fault on the over-tolerance side (see FIG. 4E), and the routine proceeds to step S8. In step S8, an alarm device such as a check lamp disposed in an instrument panel or the like (not illustrated) is driven to notify the driver of the fault in the fuel pressure sensor 13, and a trouble code indicative of an offset fault on the over-tolerance side of the fuel pressure sensor 13 is stored into a memory, and the routine is ended.

If it is determined that the fuel pressure PF is below the tolerance lower limit threshold PSL1 (PF≤PSL1), and the routine proceeds from step S5 to step S7, the routine waits until the in-cylinder direct injection engine 1 starts, and when it is determined that the in-cylinder direct injection engine 1 has started, the routine proceeds to step S9. Whether the in-cylinder direct injection engine 1 has started is determined as follows. That is, the engine speed detected by the engine speed sensor 23 is read, and if this engine speed is higher than or equal to a predetermined value, it is determined that the engine has started (elapsed time t3 in FIG. 4B).

When the in-cylinder direct injection engine 1 starts, the high-pressure fuel pump 8 is driven, and fuel controlled to a predetermined pressure by the fuel pressure control solenoid valve 8*b* that operates with a drive signal from the ECU 21 is fed to the high-pressure fuel galleries 4 and 5, causing the fuel pressure in the high-pressure fuel galleries 4 and 5 to rise.

Then, when the routine proceeds to step S9, the fuel pressure PF detected by the fuel pressure sensor 13 is read. In step S10, the fuel pressure PF is compared with a break/ground fault determination threshold PSL3. The break/ground fault determination threshold PSL3 is a value used to determine whether there is a break/ground fault in the power line that supplies electric power to the fuel pressure sensor 13. The break/ground fault determination threshold PSL3 is set to a predetermined value lower than the tolerance lower limit threshold PSL1.

If the fuel pressure PF exceeds (is higher than) the break/ground fault determination threshold PSL3 (PF>PSL3), the routine proceeds to step S11, and if the fuel pressure PF is less (lower) than or equal to the break/ground fault determination threshold PSL3 (PF≤PSL3), the routine proceeds to step S12. If there is a break or ground fault in the power line that supplies electric power to the fuel pressure sensor 13, even when the actual fuel pressure rises as the high-pressure fuel pump 8 is driven after engine start, the voltage (fuel pressure PF) outputted from the fuel pressure sensor 13 does not rise. However, if there is a characteristic fault in the fuel pressure sensor 13 itself, as the actual fuel pressure rises, the voltage (fuel pressure PF) outputted from the fuel pressure sensor 13 also rises.

Because the fuel pressure discharged from the high-pressure fuel pump 8 is relatively high, the value of the voltage outputted from the fuel pressure sensor 13 is high. As a result, by comparing the fuel pressure PF with the break/ground fault determination threshold PSL3 in step S10, it is possible to clearly discriminate whether the fault is located in the fuel pressure sensor 13 itself or on the power line side.

If the fuel pressure PF exceeds the break/ground fault determination threshold PSL3 (PF>PSL3), this indicates a behavior that the output value of the fuel pressure sensor 13 increases with a rise in actual fuel pressure, and hence it is determined that the output characteristic of the fuel pressure sensor 13 has an offset fault on the under-tolerance side (see FIG. 4E). Then, the routine proceeds to step S11. In step S11, the alarm device such as a check lamp mentioned above is driven to notify the driver of the fault in the fuel pressure sensor 13, and a trouble code indicative of an offset fault on the under-tolerance side of the fuel pressure sensor 13 is stored into a memory, and the routine is ended.

If the fuel pressure PF is less than or equal to the break/ground fault determination threshold PSL3 (PF≤PSL3), that is, if the output value of the fuel pressure sensor 13 does not increase, it is determined that the fault is due to a break or ground fault in the power line connected to the fuel pressure sensor 13, and the routine branches to step S12. In step S12, the alarm device such as a check lamp mentioned above is driven to notify the driver of a fault in the electrical system of the fuel pressure sensor 13, and a trouble code indicative of a fault in the power line connected to the fuel pressure sensor 13 is stored into a memory, and the routine is ended.

In this way, according to this implementation, whether the engine temperature TE/G immediately before turn-off of the key switch 24 reaches a full warm-up temperature is added as a condition to be satisfied in order to perform a characteristic fault diagnosis of the fuel pressure sensor 13. Accordingly, the actual fuel pressure in the high-pressure fuel galleries 4 and 5 at engine stop rises as the fuel is heated with the heat radiated by the in-cylinder direct injection engine 1, and this pressure rise causes the relief valve 8*a* to open, and the fuel pressure is leaked, thus reducing the time subsequently required for the fuel pressure in the high-pressure fuel galleries 4 and 5 to drop to a pressure equivalent to the atmospheric pressure. As a result, a fault in the fuel pressure sensor 13 can be detected even if the soak time at re-start is relatively short. This translates into increased opportunities for characteristic fault diagnosis, thus increasing the reliability of the fuel pressure sensor 13.

In this implementation, the condition that the engine temperature TE/G reach a full warm-up temperature is added as a diagnosis execution condition. Therefore, no complex diagnosis execution condition is required, and the set key-off time used for determining the soak time Ts can be set easily for each individual vehicle type, resulting in high general applicability.

The present invention is not limited to the implementation mentioned above. For example, the ECU 21 may be adapted to measure the soak time, automatically turn the key switch on when this soak time reaches the set key-off time, and perform a self-diagnosis of a characteristic fault in the fuel pressure sensor 13. In this case, the key switch is automatically turned off when the self-diagnosis is finished. In this self-diagnosis, if it is determined that PF<PSL1 in step S5 mentioned above, the routine waits until the in-cylinder direct injection engine 1 is started. It is to be noted that the in-cylinder direct injection engine according to the present invention may be a diesel engine.

The invention claimed is:

1. An apparatus for diagnosing a fuel pressure sensor characteristic fault, comprising:

a fuel injector that is opposed to each of a plurality cylinders of an engine and injects fuel directly into each of the cylinders;

a high-pressure fuel generator that is driven by the engine and generates high-pressure fuel;

a fuel pressure release unit that regulates an upper limit pressure of the high-pressure fuel;

a fuel rail that supplies the fuel injector with the high-pressure fuel discharged from the high-pressure fuel generator;

a fuel pressure sensor that is opposed to the pressure rail and detects a fuel pressure in the fuel rail; and a characteristic fault diagnosis unit that determines, after a key switch is turned off, whether a predetermined diagnosis execution condition is satisfied, and performs a diagnosis of a characteristic fault in the fuel pressure sensor if the diagnosis execution condition is satisfied, wherein the characteristic fault diagnosis unit determines that the diagnosis execution condition is satisfied at least if an engine temperature immediately before turn-off of the key switch reaches a full warm-up temperature, and if a set key-off time elapses after the key switch is turned off, and wherein if the characteristic fault diagnosis unit determines that the diagnosis execution condition is satisfied, the characteristic fault diagnosis unit determines whether the fuel pressure detected by the fuel pressure sensor is lower than a predetermined tolerance range, and if the fuel pressure is below the tolerance range, the characteristic fault diagnosis unit reads the fuel pressure detected by the fuel pressure sensor after engine start, and if the fuel pressure is higher than a ground fault determination threshold, the characteristic fault diagnosis unit determines that the fuel pressure sensor has a characteristic fault on an under-tolerance side.

2. The apparatus for diagnosing a fuel pressure sensor characteristic fault according to claim 1, wherein the characteristic fault diagnosis unit determines whether the diagnosis execution condition is satisfied when the key switch is turned on after the turn-off of the key switch.

3. The apparatus for diagnosing a fuel pressure sensor characteristic fault according to claim 1, wherein the characteristic fault diagnosis unit automatically starts the diagnosis of a characteristic fault in the fuel pressure sensor when the set key-off time elapses after the key switch is turned off.

4. The apparatus for diagnosing a fuel pressure sensor characteristic fault according to claim 1, wherein the characteristic fault diagnosis unit estimates the engine temperature on a basis of a total intake air quantity, and compares the total intake air quantity with a set intake air quantity corresponding to a full warm-up temperature determination temperature to determine whether the full warm-up temperature is reached, the total intake air quantity being a total amount of intake air from when the engine is started by turning the key switch on to when the engine is stopped by turning the key switch off.

5. The apparatus for diagnosing a fuel pressure sensor characteristic fault according to claim 2, wherein the characteristic fault diagnosis unit estimates the engine temperature on a basis of a total intake air quantity, and compares the total intake air quantity with a set intake air quantity corresponding to a full warm-up temperature determination temperature to determine whether the full warm-up temperature is reached, the total intake air quantity being a total amount of intake air from when the engine is started by turning the key switch on to when the engine is stopped by turning the key switch off.

6. The apparatus for diagnosing a fuel pressure sensor characteristic fault according to claim 3, wherein the characteristic fault diagnosis unit estimates the engine temperature on a basis of a total intake air quantity, and compares the total intake air quantity with a set intake air quantity corresponding to a full warm-up temperature determination temperature to determine whether the full warm-up temperature is reached, the total intake air quantity being a total amount of intake air from when the engine is started by turning the key switch on to when the engine is stopped by turning the key switch off.

7. The apparatus for diagnosing a fuel pressure sensor characteristic fault according to claim 1, wherein if the characteristic fault diagnosis unit determines that the diagnosis execution condition is satisfied, the characteristic fault diagnosis unit determines whether the fuel pressure detected by the fuel pressure sensor is higher than a predetermined tolerance range, and if the fuel pressure exceeds the tolerance range, the characteristic fault diagnosis unit determines that the fuel pressure sensor has a characteristic fault on an over-tolerance side.

8. The apparatus for diagnosing a fuel pressure sensor characteristic fault according to claim 2, wherein if the characteristic fault diagnosis unit determines that the diagnosis execution condition is satisfied, the characteristic fault diagnosis unit determines whether the fuel pressure detected by the fuel pressure sensor is higher than a predetermined tolerance range, and if the fuel pressure exceeds the tolerance range, the characteristic fault diagnosis unit determines that the fuel pressure sensor has a characteristic fault on an over-tolerance side.

9. The apparatus for diagnosing a fuel pressure sensor characteristic fault according to claim 3, wherein if the characteristic fault diagnosis unit determines that the diagnosis execution condition is satisfied, the characteristic fault diagnosis unit determines whether the fuel pressure detected by the fuel pressure sensor is higher than a predetermined tolerance range, and if the fuel pressure exceeds the tolerance range, the characteristic fault diagnosis unit determines that the fuel pressure sensor has a characteristic fault on an over-tolerance side.

10. The apparatus for diagnosing a fuel pressure sensor characteristic fault according to claim 1, wherein the characteristic fault diagnosis unit determines that the fuel pressure sensor has a ground fault if the fuel pressure is lower than the ground fault determination threshold.

11. The apparatus for diagnosing a fuel pressure sensor characteristic fault according to claim 1, wherein the engine temperature comprises a temperature of the engine when the engine was running.

12. The apparatus for diagnosing a fuel pressure sensor characteristic fault according to claim 1, wherein the engine temperature is determined in a state when the key switch is turned on and the engine is turned on.

13. The apparatus for diagnosing a fuel pressure sensor characteristic fault according to claim 1, wherein when the key switch is turned on, the characteristic fault diagnosis unit determines whether one of the engine temperature immediately before turn-off of the key switch is equal to or greater than the full warm-up temperature and if the set key-off time elapses after the key switch is turned off is satisfied.

14. The apparatus for diagnosing a fuel pressure sensor characteristic fault according to claim 1, wherein the predetermined diagnosis execution condition includes if the fuel pressure at the turn-off of the key switch exceeds a relief pressure of a relief valve of the fuel pressure sensor.

* * * * *